United States Patent [19]

Graham

[11] Patent Number: 4,606,333

[45] Date of Patent: Aug. 19, 1986

[54] PORTABLE CERVICAL SPINE TRACTION DEVICE

[76] Inventor: Erwin W. Graham, 13565 Wendy La., Saratoga, Calif. 95070

[21] Appl. No.: 662,333

[22] Filed: Oct. 17, 1984

Related U.S. Application Data

[63] Continuation-in-part of Ser. No. 585,361, Mar. 1, 1984, Pat. No. 4,593,684.

[51] Int. Cl.[4] ..... A61H 1/02

[52] U.S. Cl. ..... 128/75

[58] Field of Search ..... 128/70–75

[56] References Cited

U.S. PATENT DOCUMENTS

| | | | |
|---|---|---|---|
| 381,187 | 4/1888 | Tracy | 272/72 |
| 833,987 | 10/1906 | Truslow | 5/440 |
| 1,747,174 | 2/1930 | Knowles | 128/71 |
| 2,581,802 | 1/1952 | Lyons | 5/440 |
| 2,703,080 | 3/1955 | Sanders | 128/71 X |
| 2,904,039 | 9/1959 | Weissenberg | 128/71 X |
| 3,046,980 | 7/1962 | Moore | 128/75 |
| 3,621,839 | 11/1971 | Barthe | 128/75 |
| 3,888,243 | 6/1975 | Powlan | 128/75 |
| 3,960,145 | 6/1976 | Scarbrough | 128/71 |
| 4,124,126 | 3/1964 | Spinks | 128/71 |
| 4,166,459 | 9/1979 | Nightingale | 128/75 |
| 4,508,109 | 4/1985 | Saunders | 128/75 |
| 4,515,406 | 5/1985 | Fujiyama et al. | 297/409 |

FOREIGN PATENT DOCUMENTS

| | | | |
|---|---|---|---|
| 1020154 | 11/1957 | Fed. Rep. of Germany | 128/78 |
| 2355848 | 5/1974 | Fed. Rep. of Germany | 128/71 |
| 3037619 | 5/1982 | Fed. Rep. of Germany | 128/75 |
| 2290184 | 6/1976 | France | 128/75 |

*Primary Examiner*—Clifford D. Crowder

[57] ABSTRACT

A compact cervical traction apparatus having a carriage which is slideable over a base, the carriage carrying a head supporting band and the base supporting a foldable leg. The leg supports a weight and an arrangement of pulleys which provides a mechanical advantage. In an upright position, the leg is perpendicular to the base, while in a folded position the leg is parallel to the base. A pad, hinged to an end of the base for folding, anchors the apparatus during use by the shoulder weight of a patient. In a folded configuration the pad, base, carriage and leg, are all in parallel planes, one above the other.

19 Claims, 8 Drawing Figures

PORTABLE CERVICAL SPINE TRACTION DEVICE

CROSS REFERENCE TO RELATED APPLICATION

This application is a continuation-in-part of application Ser. No. 585,361 filed Mar. 1, 1984, now U.S. Pat. No. 4,593,684.

TECHNICAL FIELD

The invention relates to a portable cervical traction device.

BACKGROUND ART

Vertebral problems of the cervical spine sometimes require the relief of excessive intervertebral pressure. Traction is required to elongate the cervical spine to release this pressure. The most commonly used method is to have the subject seated with a neck and chin strap to which tension is applied through a rope over a pulley with a weight attached. The chin strap stresses the temporomandibular joint with possible pain and deformity of the joint. The chin strap immobilizes the jaw and prevents talking. Since the head weighs approximately ten pounds, this weight must be exceeded before any effective elongation of the cervical section can take place.

Other procedures employ straps which are wrapped around the head at the occipital area and also use a forehead strap to hold the head. The presence of tension across the forehead and temple requires more elaborate harness straps. A chin and head strap require auxilliary suspension points such as a door. A traction device for a reclining patient is known which has a neck supporting yoke for applying force at the occipital region. An elastically biased carriage holding the yoke applies force. The unit must be attached to a mattress for anchoring.

An object of the invention was to devise a cervical traction apparatus which is self-contained and used without support equipment, such as a door. Another object of the invention was to devise a cervical traction apparatus which is portable, light weight and compact for storage.

DISCLOSURE OF THE INVENTION

The above objects have been met with a cervical traction apparatus which features a foldable construction in which a compact, force-exerting member having a mechanical advantage is employed. The member uses a variable amount of light weight to provide traction. The construction includes a horizontal base having a movable carriage on which is mounted a brace which supports a flexible band. The band cradles the occipital area of the skull. The weight of the head maintains the tension of the resilient, flexible band against the occipital bone to hold the head in place. Tension is applied to the carriage by means of a leg supported block-and-tackle arrangement of pulleys and a cable which furnish a mechanical advantage of four so that selected amounts of relatively light weights may be used to apply a force equivalent to the application of four times that amount at the cervical region. Thus, if a traction of 12 pounds is required, an easily handled weight of only three pounds would be needed. The support leg is a relatively short member, hinged to the base so that the entire traction device can be rapidly folded down and stored.

When traction is applied an anchor is required to keep the apparatus from slipping. For this purpose a pad is fastened to the forward edge of the base. The weight of the body on the pad keeps the traction apparatus from slipping. The pad can be folded under the base when not in use, for a more compact and storable unit. The apparatus also includes a hanger for storing the unit on a closet rod.

This cervical traction apparatus provides the advantages of convenient storage, portability, ease of set-up and the application of large traction forces using light, easily handled weights.

BEST MODE FOR CARRYING OUT THE INVENTION

Figures 1, 2:
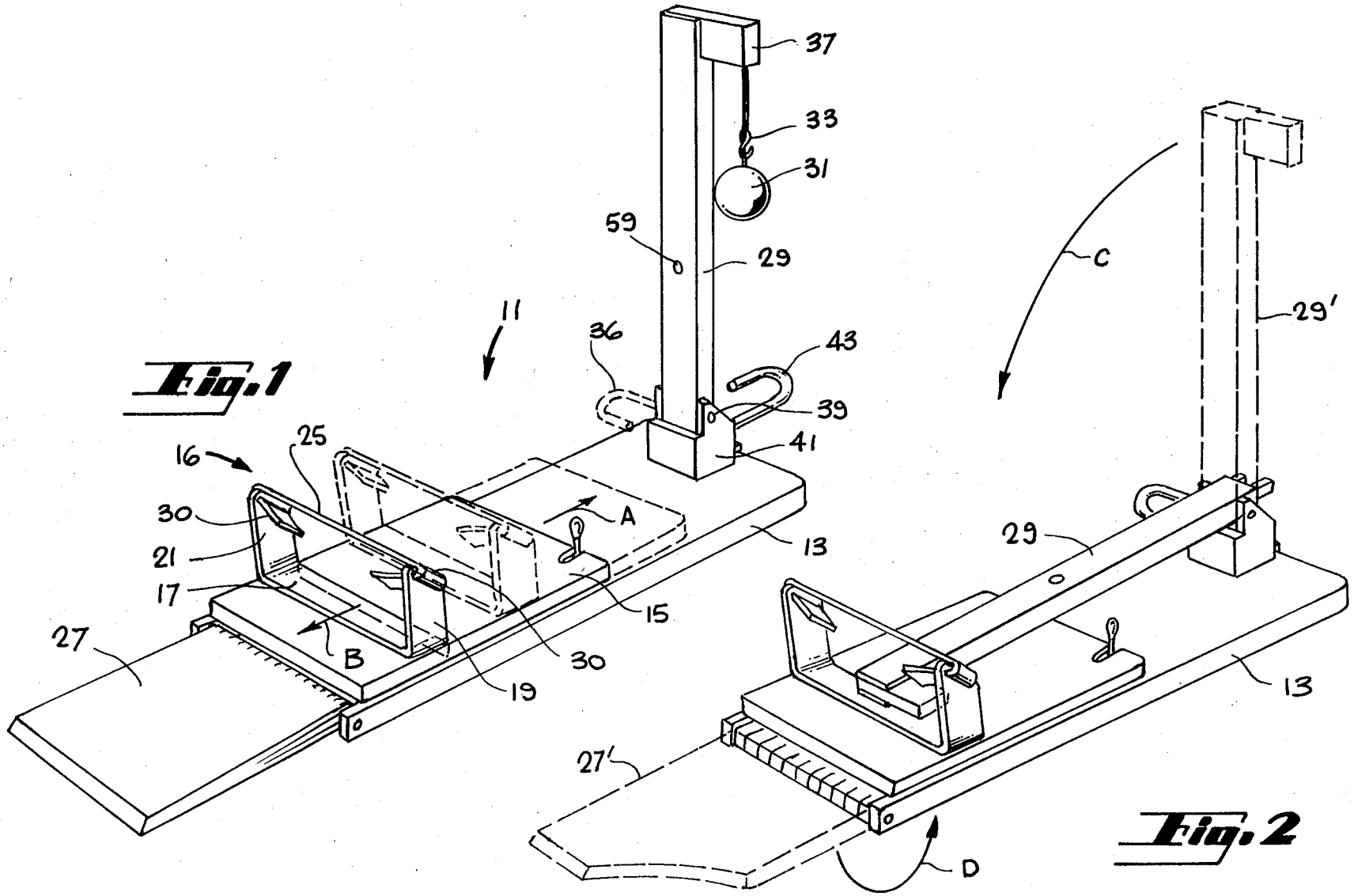
FIG. 1 is a perspective front view of the cervical traction apparatus of the present invention.
FIG. 2 is another perspective front view of the apparatus of FIG. 1, illustrating the folding construction feature.

With reference to FIG. 1, head traction apparatus 11 has a flat, elongated base 13, horizontally disposed. The base has dimensions of approximately 20 inches long, seven and one-half inches wide, and one-half inch deep. A carriage 15 with dimensions ten inches long and seven and one-half inches wide and one-half inch in height is mounted so as to move horizontally back and forth just over the base in the directions of the arrows A and B.

Mounted near the forward end of the carriage is a head cradle assembly 16 consisting of a metal brace 17 having two upwardly extended side arms 19 and 21 with a head supporting band 25 connected therebetween. The side arms are about three inches high and about seven and one-half inches apart from each other, and have the taut, wide flexible band 25 anchored through narrow slots 30 in each side arm. The side arms of the brace are of a trapezoid shape. Due to the angle of the slots the band lies in a tilted position at an angle between 30°–60° from the horizontal, thereby facing toward the rear of carriage 15. The band has a thickness of approximately three-sixteenths inches and a width of two inches at the mid-section, with the width at the support ends being about one and one-half inches. The head supporting band is made of a resilient elastomeric material such as silicone rubber and has an optimum durometer measurement of **45–55*d*** which flexes to fit to the shape of the occipital area of the skull when the back of the head is placed in the head support. During application of traction, the band cradles the head at the occipital areas at the back of the skull. Application of the pressure at the occipital area distributes the pressure uniformly over a wide area and allows the patient to rest comfortably during treatment.

The force which is applied to the head causes the supporting unit to move forward. This is overcome in the invention by an anchor pad. During traction, a reclining patient's back rests on the anchor pad 27, which may be made of foam on metal covered with durable material, similar to a thin canvas pillow. The anchor pad is approximately the same width as the base and may be of varying lengths. Preferably the pad should be shorter than the base to permit it to be folded under the base for shipping and storage.

Figure 3:
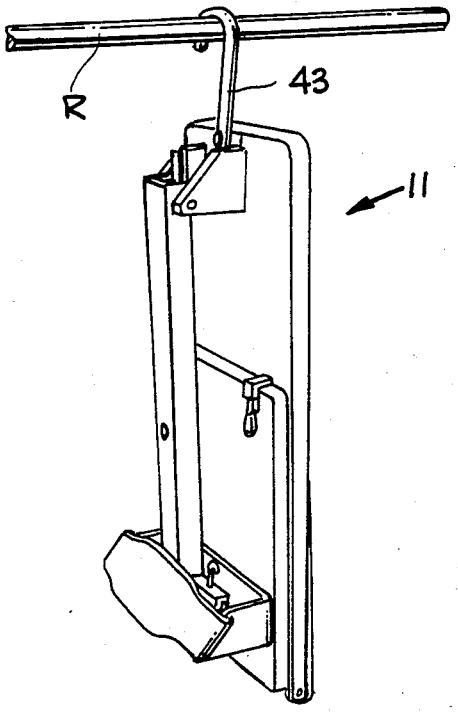
FIG. 3 is a perspective view of the apparatus of FIG. 1 in a storage configuration.

Traction forces are applied to move the carriage and head band in the direction of the arrow A. A cable system attached to carriage 15 runs under the base to a pulley at the base of leg 29, up the leg and over to a weight 31 suspended from a projecting arm 37 by a hook 33. Leg 29 is approximately 15 inches long and one and one-half inches wide. Arm 37 extends about two inches out from the side of the leg. Pivot support 41 has a pivot 39 which allows the leg 29 to pivot to the position shown in FIG. 2. Hanger 43 is for hanging the unit for storage as shown in FIG. 3. It may be rotated out of the way as indicated by dashed line 36, in FIG. 1.

FIG. 2 shows leg 29 having been folded downwardly in the direction indicated by arrow C, with dashed lines 29' indicating the former position. Also, the pad has been folded beneath base 13 as indicated by arrow D, the former position of the pad being indicated by the dashed lines 27'.

The entire apparatus, when folded, may be compactly stored, as illustrated in FIG. 3. Hanger 43 is seen supporting head traction apparatus 11 from rack R.

Figure 4:
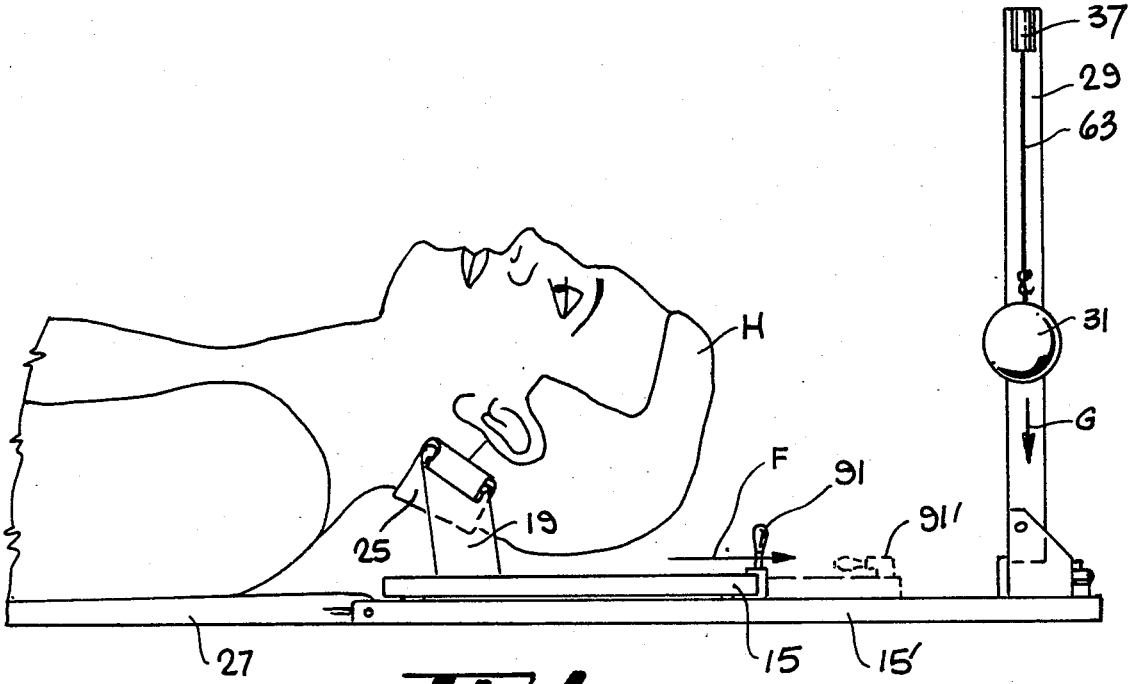
FIGS. 4 and 5 are side views of the apparatus of FIG. 1 illustrating the application of cervical traction to a user.

Operation of the cervical traction device of the present invention may be understood with reference to FIG. 4. Here, a user's head H is positioned such that the occipital region is cradled in band 25 and the upper back is resting on pad 27. Weight 31 is suspended by means of cable 63 over a series of pulleys within arm 37 and leg 29, in order to gain a mechanical advantage and transmit a gravitational force, indicated by arrow G. By attaching the end of cable 63 opposite the weight, to the top of block 57 and attaching cable 35 to the bottom of block 57 and the opposite end of the cable 35 to carriage 15 (FIG. 7), force can be exerted in the direction indicated by the arrow F, pulling the carriage 15' in a direction such that traction is exerted against the head, moving bracket side arm 19 into a new position.

The device has a locking mechanism which suspends the weight 31 at its highest position to enable the user to position the head in the cradle without the application of force. When the head is comfortably positioned, the user disengages the pivotal locking device (91) from the receptacle mounted in the base. In position 91' the carriage is free to slide and permit the weight to travel in the direction of arrow G.

Figure 5:
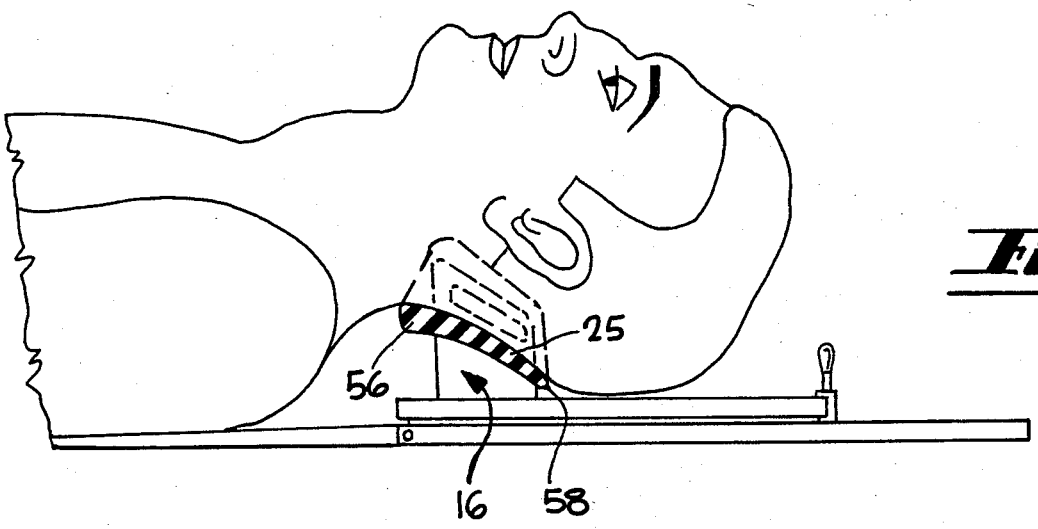

As shown in FIG. 5, band 25 has a variation in thickness from about 3/16 of an inch at forward edge 56 to a thickness of about 1/16 of an inch at rearward edge 58. The thicker front edge fits against the base of the skull and the taper provided by the thickness variation promotes a better grip of the occipital area for various head sizes and shapes. A user is free to disengage from the head cradle assembly 16 at any time without assistance.

Figure 6:
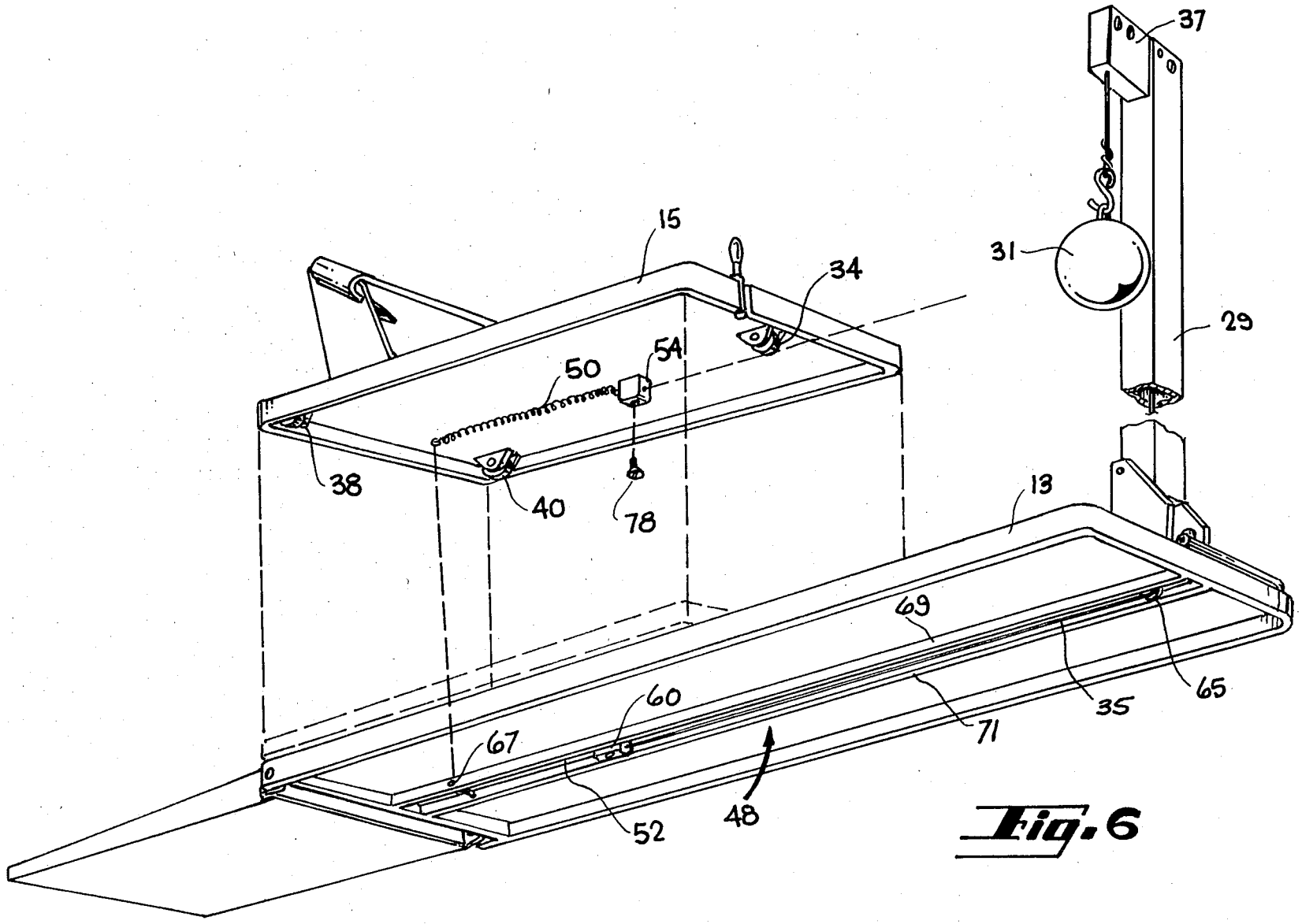
FIG. 6 is an assembly view of the apparatus of FIG. 1.

As shown in FIG. 6, carriage 15 rides on the surface of base 13 by means of three wheels 34, 38 and 40. Wheel 34 is set under the middle of the rear of carriage 15 and wheels 38 and 40 are set under opposite corners of the front of the carriage. Both the base 13 and carriage 15 are formed with downturned edges which serve to protect the wheels under the carriage and a biasing spring 50 which may be attached from the under part of the carriage to the base to bias the carriage in either a frontward or rearward direction as desired. Spring 50 is attached at the front terminal 67 of the base, thereby biasing the carriage in a frontward direction. This returns the carriage to the front of the base after removal of external traction forces. A channel 48 defined between two parallel protective rails 69 and 71 extends lengthwise along the midline of the bottom surface of the base. Slider 60 runs in the channel under the carriage area through a slot 52 cut in the base above the channel and is attached to the under surface of the carriage and the spring by means of spacer block 54. A stop pin 78 connected to the carriage bottom limits travel of the carriage in the slot at the point where the slot ends. By this means the carriage is slideably mounted on the base. Carriage 15 is pulled by cable 35 which extends from slider 60 along slot 52 to pulley 65, then up leg 29 to bottom of block 57, FIG. 7.

Figure 7:
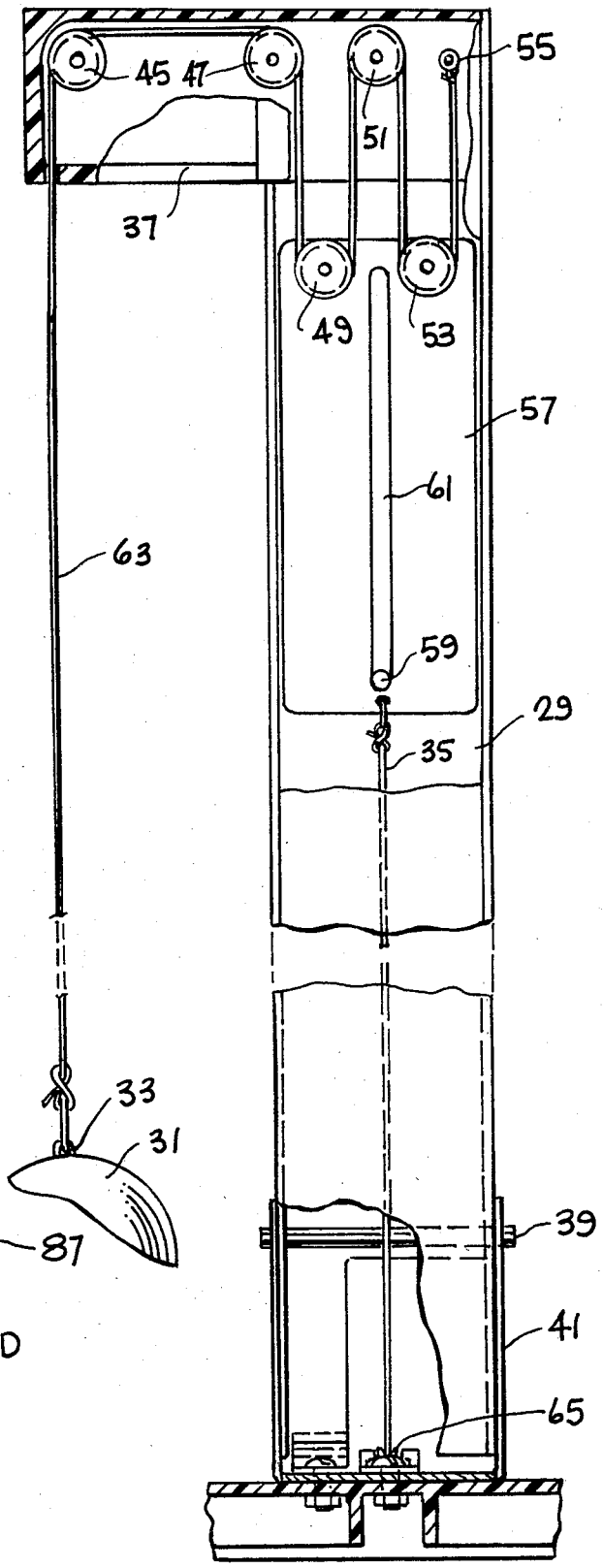
FIG. 7 is a partial sectional view of a force-exerting member with a mechanical advantage used in the apparatus of FIG. 1.

As shown in FIG. 7, the weight 31 is suspended by cable 63 which passes over a series of pulleys 45, 47, 49, 51 and 53 at the top of leg 29 and arm 37 to an anchor 55. Pulleys 49 and 53 are attached to the top of a block 57 which moves up and down the leg to an extent limited by a pin 59 in a vertical slot 61 cut in the center of the block. This movement is transmitted to a second cable 35 attached to the bottom of the block and which runs inside the leg, around a pulley 65 set in the base, through a slot in the base to a connection at the carriage. Leg 29 is approximately 15 inches long.

The illustrated arrangement of pulleys yields a mechanical advantage of four. Other mechanical advantages may be obtained by altering the number of cables and pulleys. The applied weight 31 is selected to be one-fourth the desired traction force. A three-pound weight on hook 33 results in a traction force of 12 pounds at the head support. Leg 29 has a pivot pin 39 through support 41 around which the leg may be folded toward the base.

Figure 8:
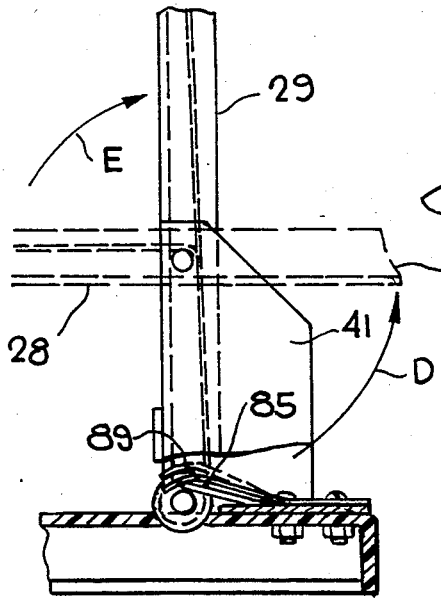
FIG. 8 is a partial sectional view of the support detail for the member illustrated in FIG. 7, the section at right angles to the view of FIG. 7.

FIG. 8 shows the detail of the folding action of the leg 29. When leg 29 is in an upright position in the direction of the arrow E it is locked in place by pressure of foot 87 against leaf spring 85. When leg 29 is in a folded position in the direction of arrow D as shown by the dashed lines 28 the leaf spring returns to a position shown by dashed lines 89. The size of the folded apparatus is approximately 20 inches long, eight inches wide and four inches in depth.

The entire unit, without added weights, weighs approximately three pounds. The base carriage and leg may be molded from a plastic such as an ABS resin. These are light weight, have good impact strength, are dimensionally stable and resistant to most oils and chemicals. The brace for the head cradle may be of steel, aluminum or plastic. The head band should preferably be of a hypo-allergenic material such as a silicone rubber of a thickness to give a good support to the occipital area. The anchor and pad may be padded for comfort with foam rubber and covered with a soil resistant material.

I claim:

1. A portable cervical spine traction apparatus comprising, a horizontally disposable, elongated support base, a carriage slidably mounted over the base and having a resilient elastomeric head support band connected thereto engaging the occipital region by elastomeric flexing, and a gravitational traction means foldably connected to the base, said traction means employing a mechanical advantage of at least 2:1 ratio for transferring traction force to the carriage and having a collapsed position parallel to the base wherein the traction means has a length no greater than the length of the base, the length of the folded apparatus not exceeding four feet.

2. The apparatus of claim 1 further including an anchor pad connected to an end of the base, the anchor pad accommodating the upper back of a user.

3. The apparatus of claim 2 wherein said anchor pad is hinged to the base.

4. The apparatus of claim 1 wherein the traction means comprises a leg foldably mounted relative to the base, the leg having a series of pulleys associated therewith for creating said mechanical advantage.

5. The apparatus of claim 4 wherein said leg has two positions, including an upright position perpendicular to the base and a folded position parallel to the base.

6. The apparatus of claim 1 wherein the base and the carriage are two parallel closely spaced members having similar width and thickness dimensions.

7. The apparatus of claim 1 wherein the carriage is supported over the base by wheels.

8. The apparatus of claim 1 wherein said traction means includes a leg having a sliding block therein with opposed ends, one end of the block connected by a cable to said carriage and another end connected by a cable to a weight, said weight adapted to hang from said leg in a gravitational field.

9. The apparatus of claim 1 wherein said head support member comprises a U-shaped brace having an elastomeric band inclined at an angle with respect to the carriage for receiving the occipital region of a user's head.

10. The apparatus of claim 1 wherein a locking mechanism is installed on the slideably mounted carriage, the locking mechanism having means for holding weight at its highest position.

11. A portable cervical spine traction apparatus comprising, a planar support base having a planar carriage mounted thereon for slideable motion and means for limiting the relative motion of the base and carriage to linear motion, a U-shaped brace mounted on the carriage, said U-shaped brace supporting an elastomeric band inclined at an angle with respect to the carriage for engaging the occipital region of a user's head by elastomeric flexing, a foldable upright leg connected to the base, said leg supporting a weight adapted to fall in a gravitational field, said weight connected by a cable system to said planar carriage, said cable system having a mechanical advantage of at least 2:1, said upright leg having a collapsed position parallel to the base, the length of the folded apparatus not exceeding four feet.

12. The apparatus of claim 11 further including an anchor pad connected to an end of the base, the anchor pad accommodating the upper back of a user.

13. The apparatus of claim 12 wherein said anchor pad is hinged to the base.

14. The apparatus of claim 11 wherein said leg includes a pulley system with a mechanical advantage for supporting said weight.

15. The apparatus of claim 11 wherein said leg has two positions, including an upright position perpendicular to the base and a folded position parallel to the base.

16. The apparatus of claim 11 wherein the base and carriage have similar width and thickness dimensions.

17. The apparatus of claim 11 wherein the carriage is supported over the base by wheels.

18. The apparatus of claim 11 wherein said leg is tubular, having a sliding block therein and opposed ends, one end connected by said cable to said weight, said weight adapted to hang from said leg in said gravitational field.

19. The apparatus of claim 11 wherein said locking mechanism is installed on the planar carriage to stop the slideable motion across said planar support base.

* * * * *